US007889040B2

(12) United States Patent
Viitanen et al.

(10) Patent No.: US 7,889,040 B2
(45) Date of Patent: Feb. 15, 2011

(54) DC INDUCTOR

(75) Inventors: Tero Viitanen, Vantaa (FI); Paulius Pieteris, Espoo (FI); Esa Hautakorpi, Helsinki (FI)

(73) Assignee: ABB Oy, Helsinki (FI)

( * ) Notice: Subject to any disclaimer, the term of this patent is extended or adjusted under 35 U.S.C. 154(b) by 426 days.

(21) Appl. No.: 12/155,632

(22) Filed: Jun. 6, 2008

(65) Prior Publication Data

US 2008/0303620 A1 Dec. 11, 2008

(30) Foreign Application Priority Data

Jun. 8, 2007 (EP) ..... 07109844

(51) Int. Cl.
*H01F 21/00* (2006.01)
*H01F 17/06* (2006.01)
*H01F 27/24* (2006.01)

(52) U.S. Cl. ..... 336/110; 336/175; 336/212

(58) Field of Classification Search ..... 336/212, 336/214, 219, 178, 110
See application file for complete search history.

(56) References Cited

U.S. PATENT DOCUMENTS 3,209,295 A 9/1965 Baermann
3,968,465 A * 7/1976 Fukui et al. ..... 336/110
4,794,360 A * 12/1988 van Mensvoort ..... 336/178
5,821,844 A * 10/1998 Tominaga et al. ..... 336/110
6,611,187 B2 * 8/2003 Matsumoto et al. ..... 336/110
6,734,771 B2 * 5/2004 Okita et al. ..... 335/229
6,734,773 B2 * 5/2004 Ackermann ..... 336/178
2002/0159277 A1 10/2002 Matsumoto et al.
2004/0140876 A1 * 7/2004 Kondo ..... 336/110

FOREIGN PATENT DOCUMENTS

EP 0 210 691 A 2/1987
EP 0 744 757 A 11/1996
GB 1 480 134 A 7/1977
JP 2003-318046 11/2003

OTHER PUBLICATIONS

European Search Report.

* cited by examiner

*Primary Examiner*—Anh T Mai
(74) *Attorney, Agent, or Firm*—Buchanan Ingersoll & Rooney PC

(57) ABSTRACT

A DC inductor comprising a core structure (11) comprising one or more magnetic gaps (12, 13), a coil (14) wound on the core structure (11), at least one permanent magnet (15) positioned in the core structure, the magnetization of the permanent magnet (15) opposing the magnetization producible by the coil (14). The DC inductor further comprises at least one magnetic slab (16) inserted to the core structure which forms the one or more magnetic gaps (12, 13), at least one supporting member (17) made of magnetic material extending from the core structure inside the core structure and supporting the at least one permanent magnet (15), and that the at least one supporting member (17) is arranged to form a magnetic path for the at least one permanent magnet.

21 Claims, 7 Drawing Sheets

DC INDUCTOR

FIELD OF THE INVENTION

The present invention relates to a DC inductor, and particularly to a DC inductor having at least one permanent magnet arranged in the core structure of the inductor.

BACKGROUND OF THE INVENTION

A major application of a DC inductor as a passive component is in a DC link of AC electrical drives. Inductors are used to reduce harmonics in the line currents in the input side rectifier system of an AC drive.

The use of permanent magnets in the DC inductors allows minimizing the cross-sectional area of the inductor core. The permanent magnets are arranged to the core structure in such a way that the magnetic flux or magnetization produced by the permanent magnets is opposite to that obtainable from the coil wound on the core structure. The opposing magnetization of coil and permanent magnets makes the resulting flux density smaller and enables thus smaller cross-sectional dimensions in the core to be used.

As is well known, permanent magnets have an ability to become demagnetized if an external magnetic field is applied to them. This external magnetic field has to be strong and applied opposite to the magnetization of the permanent magnet for permanent de-magnetization. In the case of a DC inductor having a permanent magnet, de-magnetization could occur if a considerably high current is led through the coil and/or if the structure of the core is not designed properly. The current that may cause de-magnetization may be a result of a malfunction in the apparatus to which the DC inductor is connected.

Document EP 0 744 757 B1 discloses a DC reactor in which a permanent magnet is used and the above considerations are taken into account. The DC reactor in EP 0 744 757 B1 comprises a core structure to which the permanent magnets are attached. The attachments of the permanent magnets are vulnerable to mechanical failures since the permanent magnets are merely attached to one or two surfaces. Further the core structures in EP 0 744 757 B1 are fixed to a specific current or inductance rating leaving no possibility of expanding said rating using the same core structure and dimensioning.

One of the problems associated with the prior art structures relates thus to a possibility of modifying the same core structure for different current levels or purposes.

BRIEF DESCRIPTION OF THE INVENTION

An object of the present invention is to provide a DC inductor so as to solve the above problem. The object of the invention is achieved by a DC inductor, which is characterized by what is stated in the independent claim. The preferred embodiments of the invention are disclosed in the dependent claims.

The invention is based on the idea of providing a core structure that can be easily modified for different current levels. The core structure of the invention comprises a supporting member, which supports one or more permanent magnets and produces a magnetic path for the magnetic flux or magnetization of the permanent magnets. Further, the core structure includes one or more magnetic gaps formed by one or more magnetic slabs. Modifications to the properties of the DC inductor can be achieved by modification of these slabs.

An advantage of the DC inductor of the invention is that the same basic core structure can be used for different ratings. The length of the at least one supporting member can be changed, which allows changing the number of permanent magnets used. The supporting member further affects the inductance of the inductor and can be varied to achieve a desired inductance value. Further, the one or more magnetic slabs that are in the core structure can be modified in various ways. The magnetic slabs are used to provide magnetic gaps to the main magnetic path. The length of this gap can be adjusted with differing slabs having different properties. Further the slab can be used to provide non-uniform magnetic gaps providing differing properties for the DC inductor.

Thus the present invention gives the possibility of using basic core structure that can be modified depending on the application. This leads to considerable savings in production of inductors, since only the commonly used forms of the inductor core need to be specifically structured for the intended use.

BRIEF DESCRIPTION OF THE DRAWINGS

In the following the invention will be described in greater detail by means of preferred embodiments with reference to the accompanying drawings, in which.

DETAILED DESCRIPTION OF THE INVENTION

Figure 1:
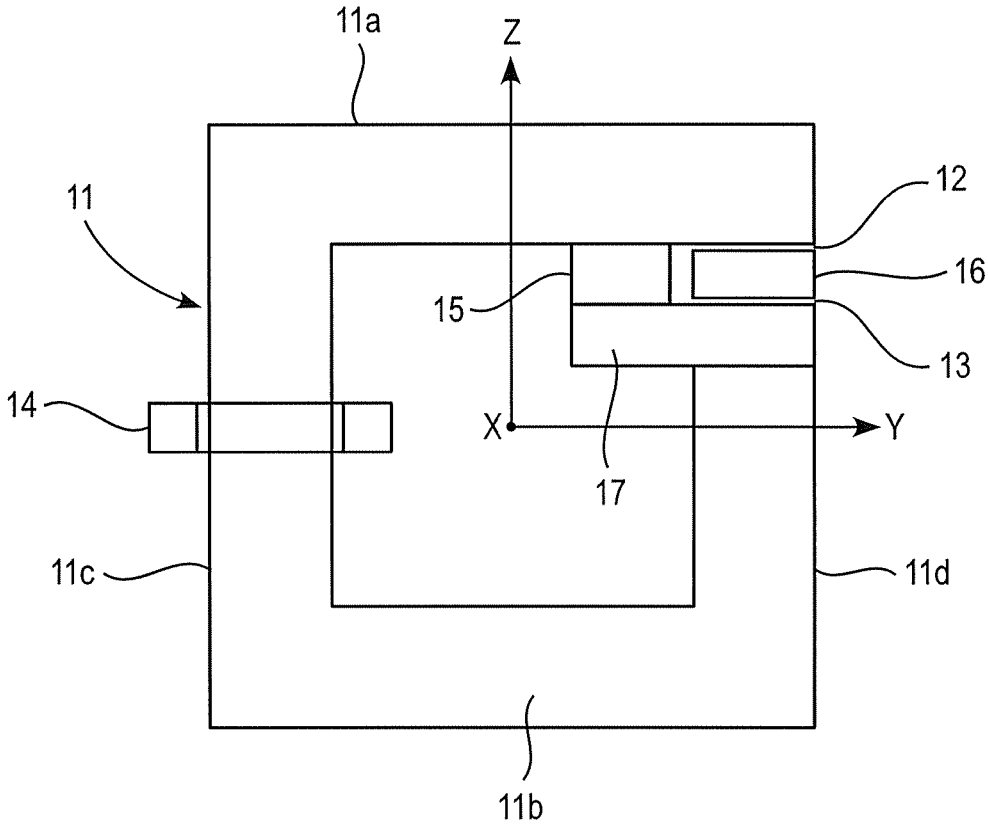
FIG. 1 shows a basic structure of the first embodiment of the invention.

FIG. 1 shows the first embodiment of the DC inductor according to the present invention. The core structure 11 is formed of a magnetic material, i.e. material that is capable of leading a magnetic flux. The material can be for example laminated steel commonly used in large inductors and as stator plates in motors, soft magnetic composite or iron powder.

The DC inductor of the invention comprises at least one coil 14 inserted on the core structure and one or more magnetic gaps 12, 13. The coil is typically wound on a bobbin and then inserted on the core structure in a normal manner. Alternatively, the coil can be wound directly to the core without a bobbin. The gaps are formed on the main magnetic path, by which it is referred to the magnetic path the magnetic flux of the coil flows. In the present invention, at least one of the possibly multiple magnetic gaps are formed by using magnetic slabs. In the embodiment of FIG. 1, the magnetic slab 16 is a separate piece that can be inserted into the core structure. The material of the magnetic slab may include the same material as of the core structure, but can also be of different materials. The material of magnetic slabs can also be other magnetic material, such as ferrite materials or the like.

Since magnetic slabs are used in the invention to create magnetic gaps, i.e. air gaps, the length and shape of the air gap so created can be varied by changing the dimensions and shape of the slab. Non-magnetic materials can also be used together with the magnetic slab(s) to support the slab(s) and to form the magnetic gap(s) to the core structure. Non-magnetic materials include plastic materials that have a similar effect in the magnetic path as an air gap. The magnetic gaps in a core structure are situated such that the gaps are used to direct or block magnetic flux in order to aid to suppress the demagnetization effect upon the permanent magnets. In addition, different magnetic gap dimensions affect differently the total inductance of the DC inductor. However, a larger air gap decreases the numerical value of the inductance of the inductor, but at the same time makes the inductance more linear while a smaller magnetic gap has the opposite effect.

FIG. 1 also shows at least one supporting member 17 made of magnetic material. The supporting member of the present invention extends from the core structure inside the core structure 11. The supporting member, which is basically an extended magnetic slab, holds or supports the at least one permanent magnet 15 in such a way that the supporting member forms a magnetic path for the magnetization or the magnetic flux of the permanent magnet. Further the supporting member can be varied to vary the inductance of the DC inductor.

Figure 2:
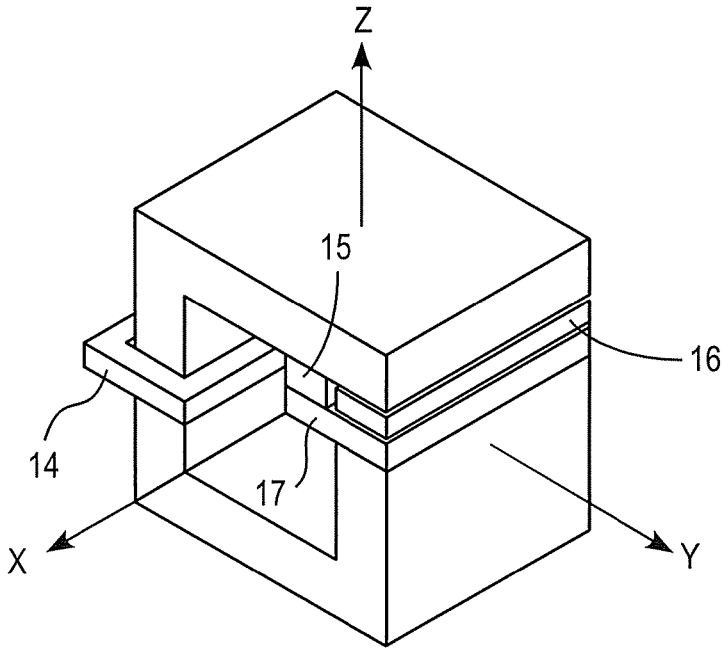
FIG. 2 shows a perspective view of the structure of FIG. 1.

In the embodiment of FIG. 1, the supporting member extends parallel to the core structure inside the core structure. In FIG. 1, the supporting member extends parallel to the upper leg 11*a* of the core structure. In FIG. 2, the embodiment of the FIG. 1 is shown in a perspective view for better understanding of the structure.

Figure 4:
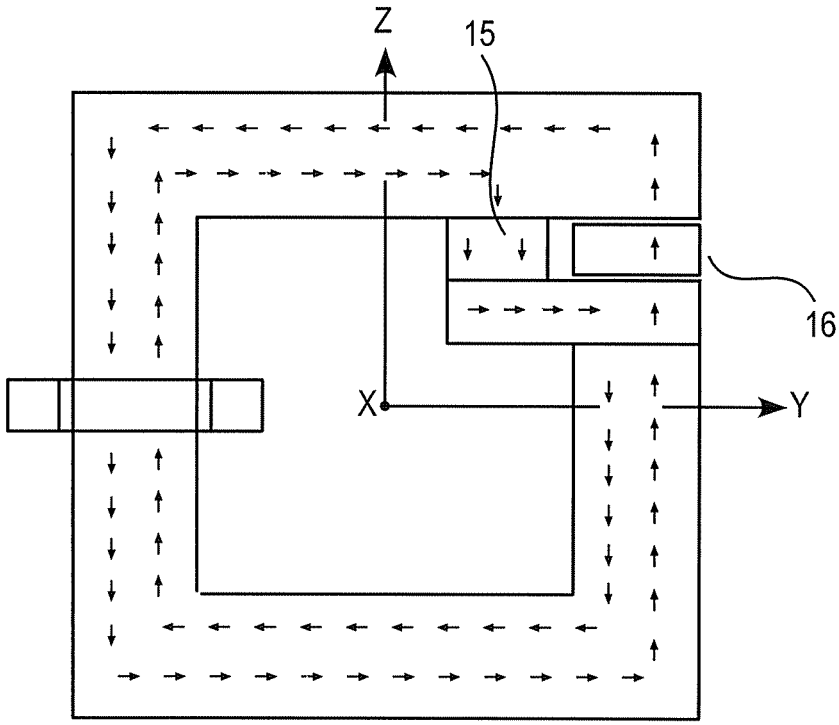
FIG. 4 shows a cross-sectional front view of the first embodiment.

The purpose of the supporting member is to support the permanent magnet 15 and simultaneously to provide a path for the magnetic flux of the permanent magnet. The flux generated by the coil senses the permanent magnet as a higher reluctance path and thus passes the permanent magnet via the magnetic slab 16. The magnetic flux of the permanent magnet on the other hand does not flow through the magnetic slab due to the reluctance encountered in air gaps, but flows through the coil 14 via the core structure and supporting member. The paths of magnetic fluxes are shown in FIG. 4, where a cross-sectional front view of the first embodiment is shown together with arrows depicting the flux paths. The outermost series of arrows travelling through the whole core structure including magnetic gaps is the path of flux from the coil. The innermost arrows depict the flux originating from the permanent magnet.

Since the supporting member is an element made of magnetic material, it can also be considered as a magnetic slab similarly to the slab 16. A magnetic gap may also be provided between the supporting member 17 and part 11*d* of the core structure. If so desired, the magnetic gap may be formed by a thin non-magnetic material piece inserted therebetween.

Figure 3:
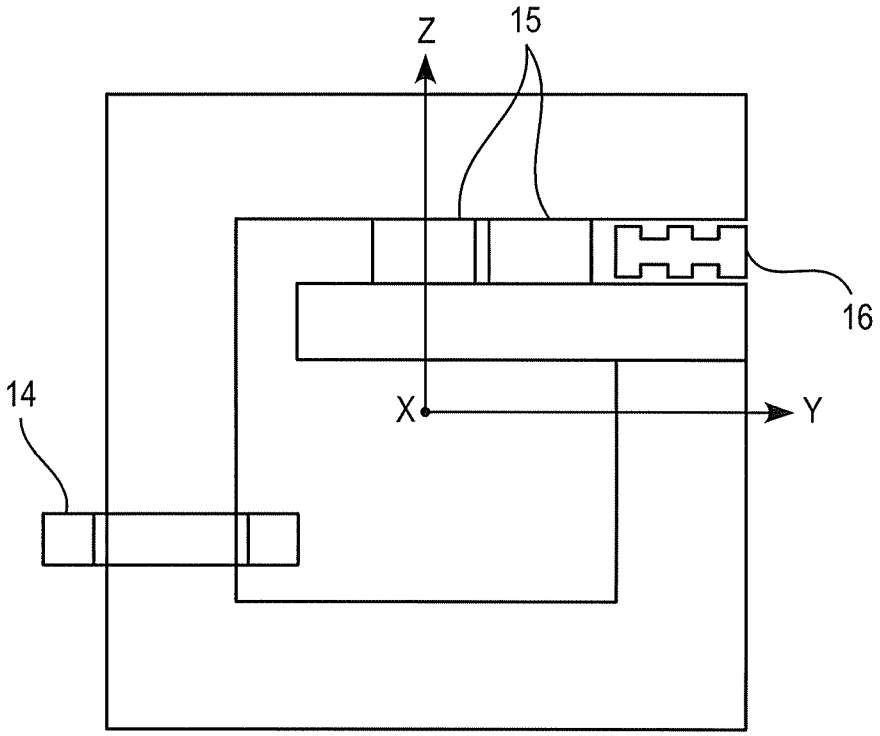
FIG. 3 shows a modification of the embodiment shown in FIG. 1.

In FIG. 1, the DC inductor is shown with only one permanent magnet 15. The present invention enables adjusting the main core structure only by extending the supporting member parallel to the core structure and adding more permanent magnets. FIG. 3 shows this possibility where the supporting member is extended to hold two permanent magnets 15. The permanent magnets are arranged in parallel relationship with each other. Further the magnetic gaps in the FIG. 3 are formed to be non-uniform. The non-uniformity is achieved by modifying the magnetic slab in a desired manner. As a result of the non-uniformity of the magnetic gaps, a varying inductance curve is achieved.

Since the permanent magnets are somewhat fragile and brittle quite easily from mechanical impacts, it is very advantageous to position them inside the core structure. It can be seen from FIGS. 1 and 3 that the core structure covers the permanent magnets so that mechanical forces cannot reach the magnets.

The permanent magnets are also strongly fastened to the core structure, since they are held in place from two opposing directions, i.e. above and below. The permanent magnets can be further glued or otherwise mechanically attached to the surrounding structure.

As seen from the FIG. 1 or 3, the permanent magnets 15 are of substantially the same height as the height of magnetic slab 16 and the magnetic gaps 12, 13. This allows the supporting member to be aligned parallel to the core structure.

Figure 5:
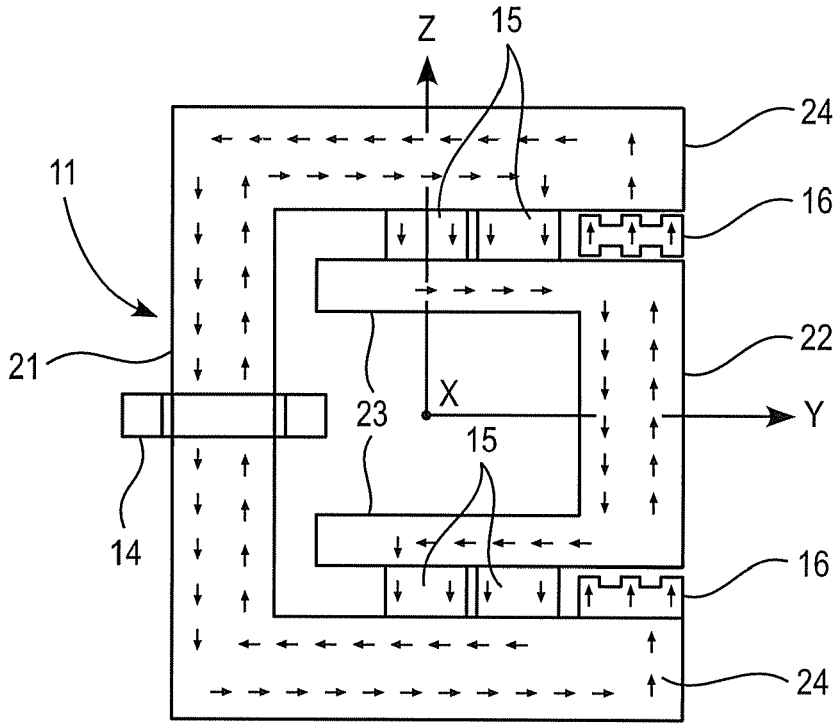
FIG. 5 shows a basic structure of the second embodiment of the invention.

FIG. 5 shows the second embodiment of the present invention. In this embodiment, two supporting members are included in the inductor. The supporting members 23 extend parallel to the core structure and inside of it. In this second embodiment, the core structure and the supporting members are formed of two U-shaped cores 21, 22. The first U-shaped core 21 forms the outer structure and the second U-shaped core 22, which is smaller than the first one, forms the supporting members 23 and one side of the main core structure. The second U-shaped core 22 is thus inserted between the legs of the first U-shaped core 21.

FIG. 5 shows four permanent magnets 15, two of them situated between both of the supporting members 23 and the core structure. The permanent magnets are thus supported by the supporting members and are held between the outer surface of the legs of the second core structure and the inner surface of the legs of the first core structure.

The magnetic slabs 16 are inserted in parallel fashion to the permanent magnets 15. The magnetic slabs are arranged in the main magnetic path, which means that slabs 16 are between the ends of the legs of the first U-shaped core and the base of the second U-shaped core. It is shown in FIG. 5 that the dimensions of the legs and base of the second U-shaped core are different. The base of the second U-shaped core carries the magnetic flux producible by the coil and similarly as the first U-shaped core, and to avoid uneven flux densities the cross sectional areas should be equal. Thus the base of the second U-shaped core has a cross-sectional area equal to that of the first U-shaped core. The supporting members, i.e. the legs of the second U-shaped core, carry mainly the flux produced by the permanent magnets and the dimensions can be made smaller. It is however clear that the dimensioning of the cross-sectional areas can be carried out depending on the present use. Also the number of permanent magnets, slabs and magnetic gaps as well as their shapes are up to the application.

The structure of FIG. 5 is very advantageous since only basic magnetic core forms are used. The length of the legs of the second U-shaped core can be varied depending on the number of permanent magnets and the desired inductance. The permanent magnets are again secured to the core structures and are kept away from any mechanical contacts inside the structure. The magnetic slabs that are used to form the magnetic gaps are as described above. In the example of FIG. 5, the magnetic slabs are used to create three magnetic gaps, which are non-linear. With the slabs shown in FIG. 5, up to four magnetic gaps can easily be made to the core structure. Any number of gaps can further be made non-uniform to obtain swinging inductance characteristics. Also the manufacturing process of the embodiment shown in FIG. 5 is simple. The first U-shaped core 21 can be directly mounted on a spindle machine and no separate bobbin for the coil is needed if extra-insulated wire is used for the coil.

Figure 6:
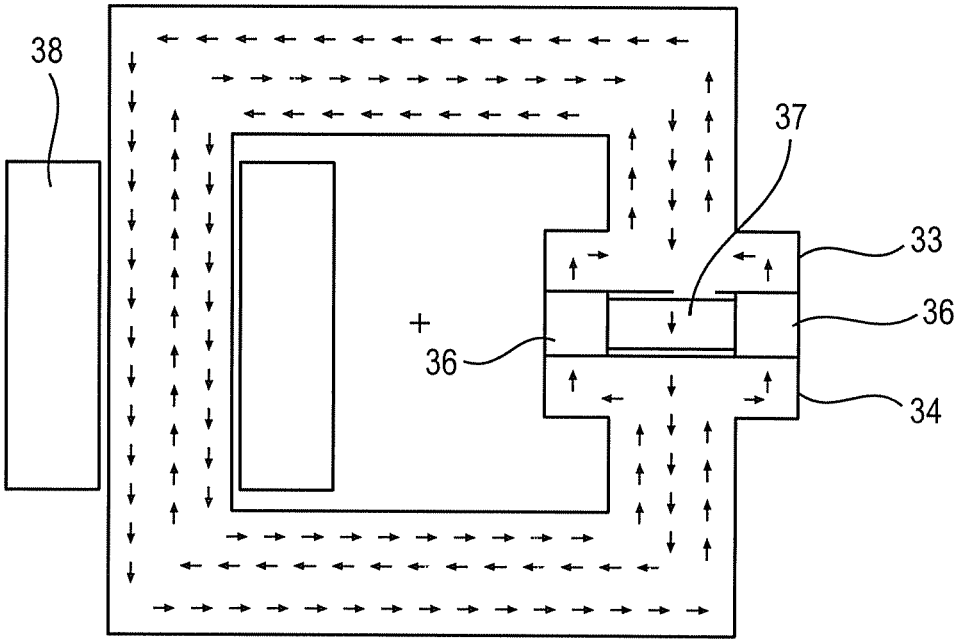
FIG. 6 shows a basic structure of the third embodiment of the invention.

FIG. 6 shows a third embodiment of the DC inductor according to the present invention. In this embodiment, two supporting members 33, 34 are supporting two permanent magnets 35, 36. The supporting members extend parallel to the core structure and inside the core structure. In this embodiment, the supporting members are also extended to outside of the core structure to hold other permanent magnet outside of the core structure.

The supporting members are extending from one leg of the core structure as shown in FIG. 6. The magnetic slab which produces one or more magnetic gaps is located according to the invention between the permanent magnets 35, 36 and the supporting members 33, 34.

FIG. 6 indicates the flux paths of the fluxes produced by the coil 38 and the permanent magnets 35, 36. The directions of the fluxes oppose each other, and the flux generated by the coil travels through the magnetic slab 37 while the flux of the permanent magnets flows through the supporting members 33, 34. Thus in the normal operation range the flux generated by the coil cannot de-magnetize the permanent magnets.

The third embodiment described above is advantageous in that the upper and lower legs of the core can be made short while still holding multiple permanent magnets, since part of the permanent magnets are held outside of the core structure, but still inside supporting members giving protection and strong support against mechanical forces.

As with the other embodiments and their modifications, the supporting members can be further extended to accommodate more permanent magnets. Also the magnetic slab may be modified as described above.

In FIG. 6, the coil is seen wound on the leg opposing the leg having the supporting members. If extra protection for the permanent magnets is needed or if otherwise desired, the coil can also be wound on the leg having the supporting members, the permanent magnets and the magnetic slab, which would then be surrounded by the coil.

Figure 7:
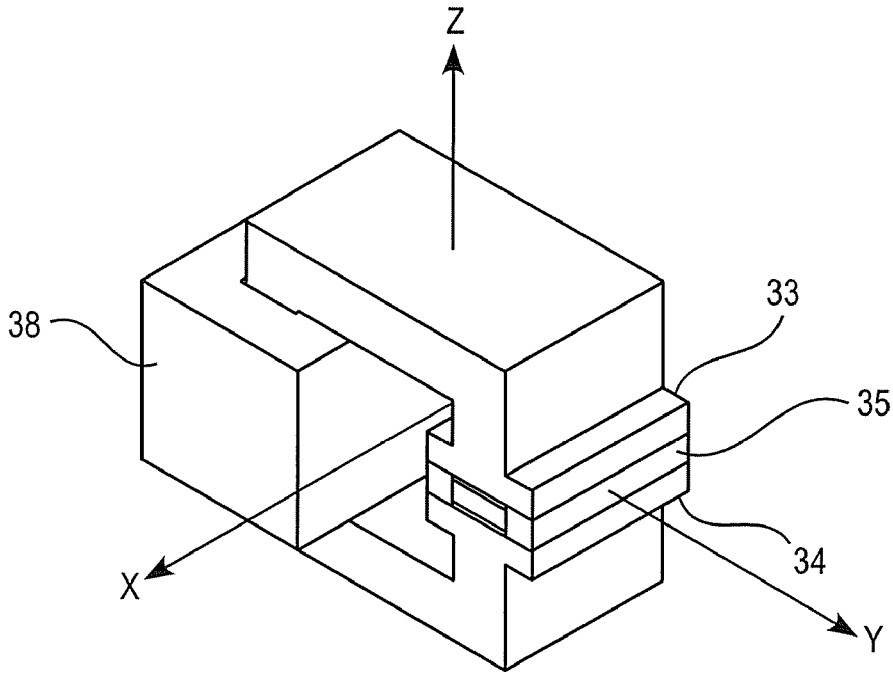
FIG. 7 shows a perspective view of the embodiment shown in FIG. 6.

FIG. 7 shows a perspective view of the embodiment shown in FIG. 6 and described above.

Figure 8:
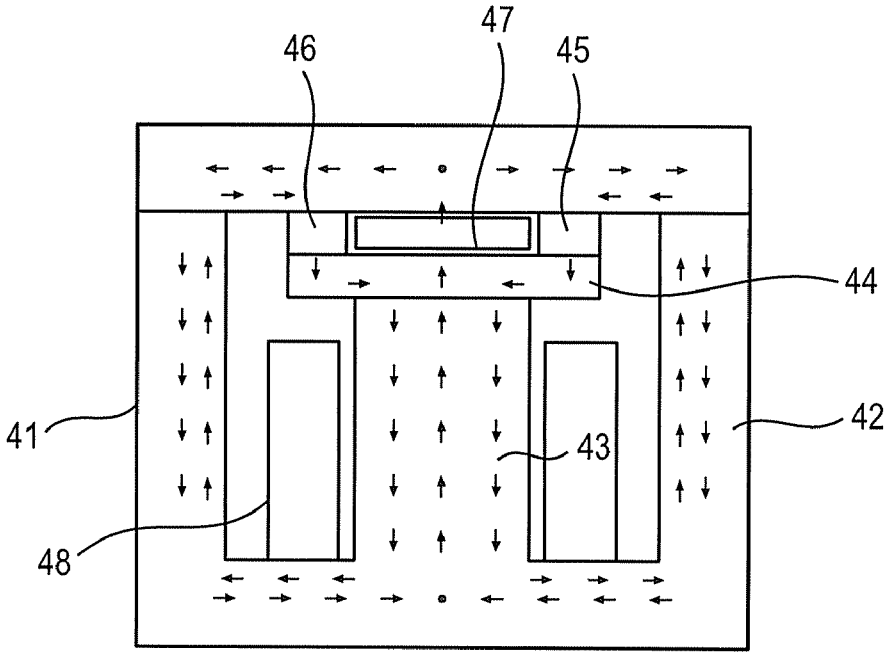
FIG. 8 shows a cross-sectional front view of the basic structure of the fourth embodiment of the invention.

FIG. 8 shows a fourth embodiment of the DC inductor according to the present invention. In this embodiment the core structure comprises three legs 41, 42 and 43 and is basically an I-W core. The I-part of the core is situated on the top of the W-core, with the supporting member arranged on the center leg 43. Supporting member 44, which extends in parallel relationship with the core structure, further holds the permanent magnets 45, 46. The permanent magnets are between the supporting member and the core structure, especially the underside of the I-core.

In the embodiment shown in FIG. 8, the supporting member holds both the permanent magnets and the magnetic slab. The magnetic slab is used to form the magnetic gaps 47 to the center leg of the core structure.

The embodiment of FIG. 8 can be further modified by substituting the I-part with a T-part. That is to say that the magnetic slab of FIG. 8 is attached or made uniform with the I-part to produce the T-part. In this modification, the supporting member is used to form the magnetic slab, thus the magnetic gap 47 is formed to the center leg 43 above the supporting member. Another magnetic gap could also be provided to the joint between the center leg 43 of the W-core and the supporting member 44.

In FIG. 8, the I-core presses against the permanent magnets 45, 46, which further press against the supporting member, which is attached to the center leg of the W-core. FIG. 8 also shows the paths of the magnetic fluxes. The flux of the coil passes through the magnetic gap 47, while the flux of the permanent magnets use the supporting member.

The permanent magnets are situated in FIG. 8 so that there is a lateral air gap between them and the center leg of the core. This is to avoid leakage flux.

As with the previous embodiments, the supporting member is extendable to accommodate multiple permanent magnets. It is also shown in FIG. 8 that the coil 48 is wound on the center leg 43 of the core structure below the supporting member. This embodiment of the invention is advantageous in that the physical dimensions are kept small while still having multiple permanent magnets inside the core structure.

Figure 9:
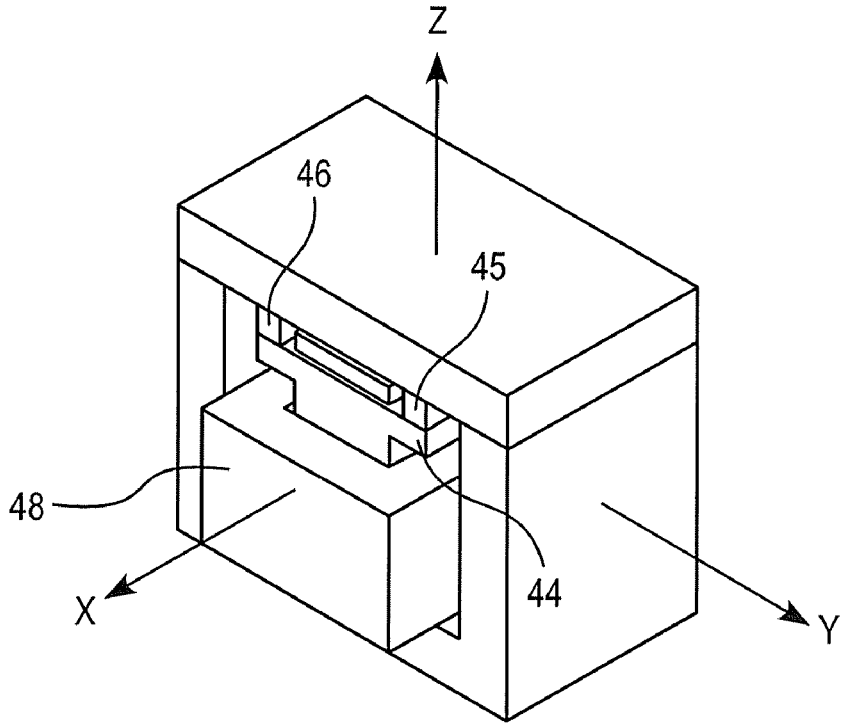
FIG. 9 shows a perspective view of the embodiment shown in FIG. 8.

FIG. 9 shows a perspective view of the embodiment shown is FIG. 8.

Figure 10:
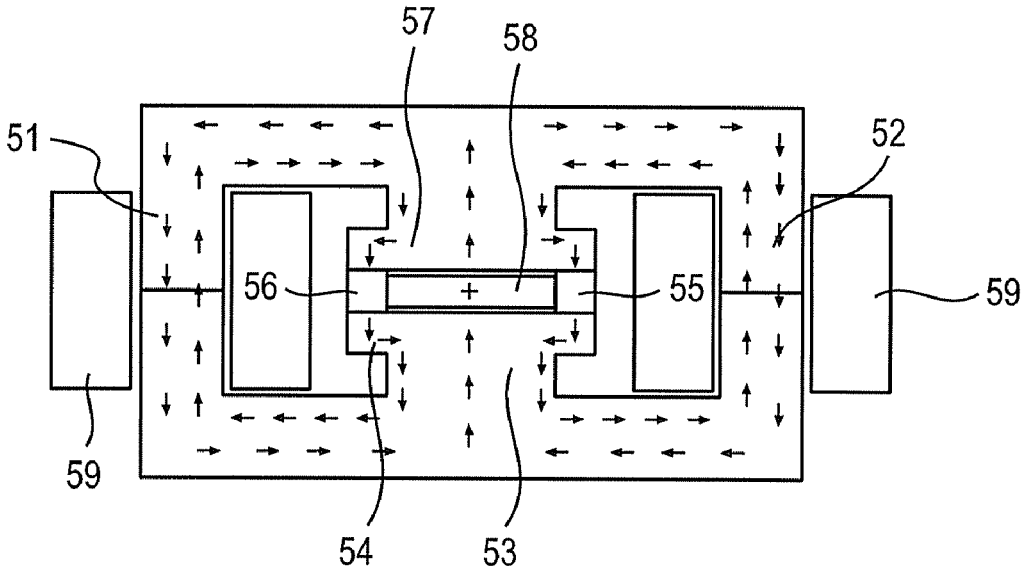
FIG. 10 shows a cross-sectional front view of a modification of the fourth embodiment of the invention.

FIG. 10 illustrates a modification of the fourth embodiment using W-W core structure. This modification comprises two supporting members 54, 57 in the center leg 53 thereof. The supporting members hold between them two permanent magnets 55, 56 and the magnetic slab 58. The magnetic slab 58 is used to form the magnetic gap in the center leg, and the supporting members hold the permanent magnets and provide a magnetic path for them.

In the modification shown in FIG. 10, the supporting members 54, 57 can be extended to hold multiple permanent magnets and the magnetic slab provided between the permanent magnets and supporting members can be modified as explained earlier.

FIG. 10 also shows the paths of the fluxes, the flux produced by the coil passing through the magnetic slab 58 and the flux produced by the permanent magnets using the supporting members 54, 57. The coil in FIG. 10 is divided into two parts 59 wound on the side legs 51, 52 of the core structure.

Figure 11:
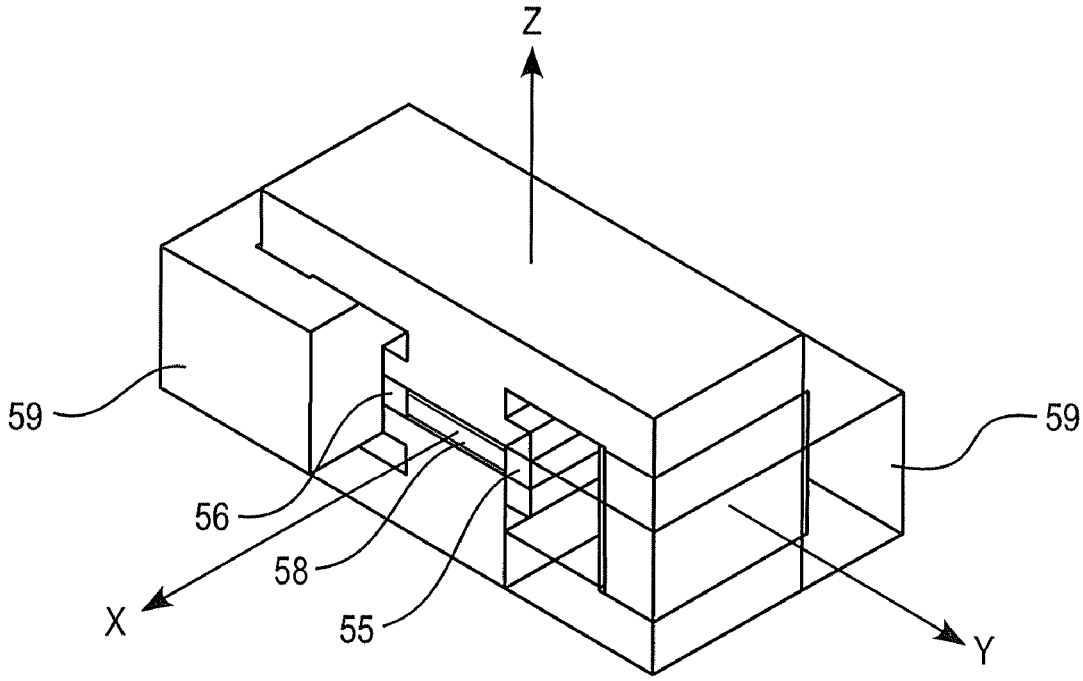
FIG. 11 shows a perspective view of the modification shown in FIG. 10.

FIG. 11 shows the structure of FIG. 10 as a perspective view.

Figure 12:
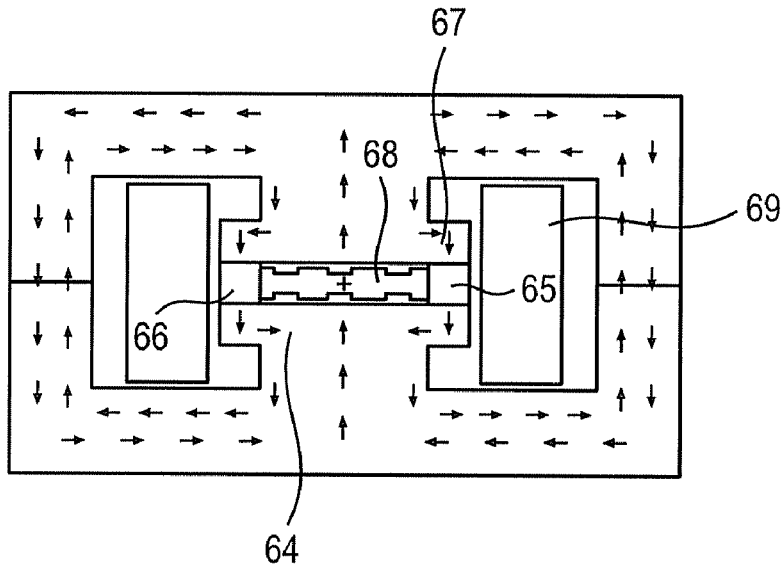
FIG. 12 shows a cross-sectional front view of another modification of the fourth embodiment of the invention.
Figure 13:
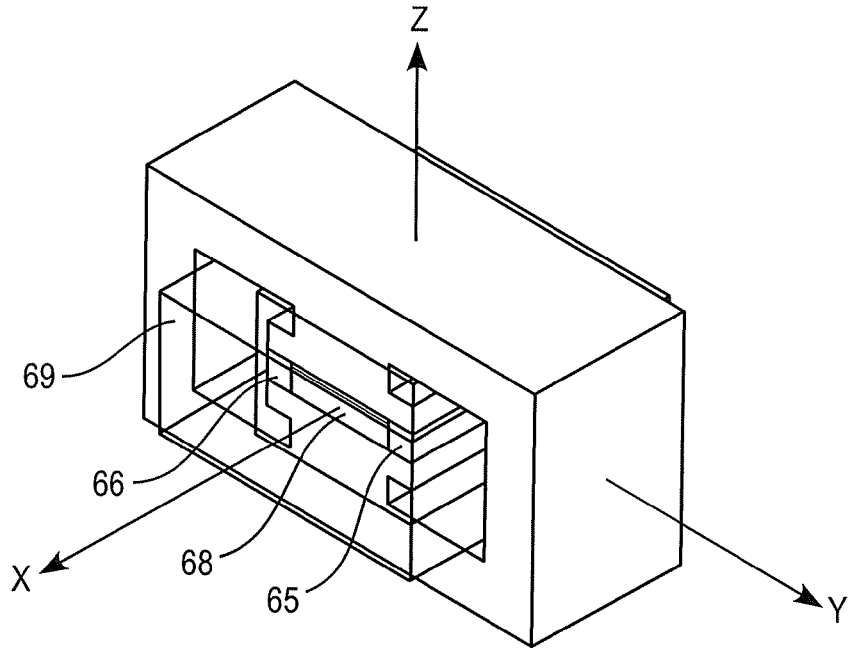
FIG. 13 shows a perspective view of the modification shown in FIG. 12.

FIG. 12 shows another modification of the fourth embodiment. This modification differs from the modification presented in FIG. 10 in that the coil is wound on the center leg, leaving inside the coil the supporting members 64, 67, the permanent magnets 65, 66 and the magnetic slab 68. This modification gives extra protection to the permanent magnets from any outer forces. Similarly to FIG. 10, the paths of the fluxes are indicated in FIG. 12. A perspective view of the DC inductor of FIG. 12 is shown in FIG. 13.

Figure 14:
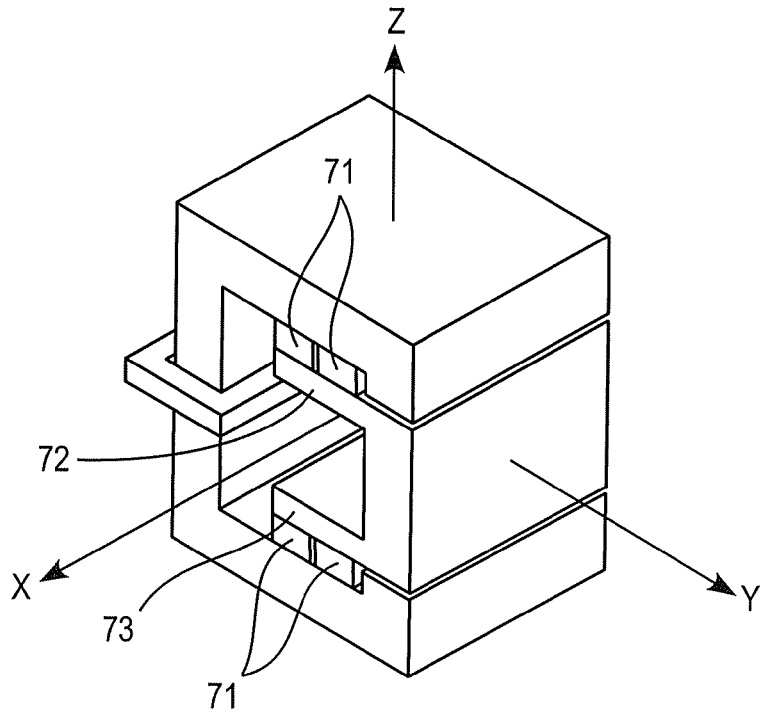
FIG. 14 shows a perspective view of a modification of the second embodiment.

FIG. 14 shows a modification of the embodiment shown in FIG. 5. In this modification, the magnetic slabs of FIG. 5 are made uniform with the core structure, and the supporting members are considered as being the magnetic slabs and are used to form magnetic gaps. In the example shown in FIG. 14, four permanent magnets 71 are disposed between the supporting members 72, 73 and the core structure.

In all of the above embodiments and their possible and described modification, the supporting members can be extended to hold more permanent magnets than shown or described. The number of the permanent magnets is not limited. Further the magnetic slabs in any of the embodiments or their modifications are modifiable. The slabs can be modified to have more or less magnetic gaps, which may be either uniform or non-uniform, depending on the intended purpose of the DC inductor. Magnetic gaps can also be provided at any joint between the supporting member and the core structure, the supporting member can thus also be considered as being a magnetic slab. Often it is more desirable to have multiple shorter magnetic gaps than one larger magnetic gap although the reluctance is defined by the total length of the magnetic gaps. This is due to the undesirable fringing effect of the magnetic flux which gets undesirable if magnetic gaps are too long.

In the above description, some shapes of magnetic material are referred to as letter shaped forms. It should be understood that a reference to a letter shape (such as "U") is made only for clarity, and the shape is not strictly limited to the shape of the letter in question. Further while reference is made to a letter shape, these shapes can also be formed of multiple parts, thus the shapes need not to be an integral structure.

The above description uses relative terms in connection with the parts of the core structure. These referrals are made in view of the drawings. Thus for example upper parts refer to upper parts as seen in the corresponding figure. These relative terms should thus not be taken as limiting.

The term coil used in the document comprises the total coil winding wound around the core structure. The total coil winding can be made of a single wound winding wire or it can be made of two or more separate winding wires that are connected in series. The total coil winding can be wound on one or more locations on the core structure. The total coil winding is characterized by the fact that the substantially same current flows through every wounded winding turns when current is applied to the coil.

It will be obvious to a person skilled in the art that, as the technology advances, the inventive concept can be implemented in various ways. The invention and its embodiments are not limited to the examples described above but may vary within the scope of the claims.

The invention claimed is:

1. A DC inductor comprising a core structure comprising one or more magnetic gaps, a coil inserted on the core structure, at least one permanent magnet positioned in the core structure, the magnetization of the permanent magnet opposing the magnetization producible by the coil, wherein the DC inductor further comprises at least one magnetic slab inserted to the core structure to form one or more magnetic gaps, at least one supporting member made of magnetic material extending from the core structure inside the core structure and supporting the at least one permanent magnet, and that the at least one supporting member is arranged to form a magnetic path for the at least one permanent magnet.

2. A DC inductor according to claim 1, wherein the at least one supporting member is arranged to extend parallel to the core structure and the at least one permanent magnet is arranged between the at least one supporting member and the core structure such that the at least one supporting member forms together with the core structure a low reluctance magnetic path for the at least one permanent magnet.

3. A DC inductor according to claim 2, wherein the at least one magnetic slab, which is used to define the magnetic gap, is arranged on the supporting member and arranged to form part of the magnetic path for the magnetization producible by the coil.

4. A DC inductor according to claim 1, wherein the core structure comprises an upper leg and that the supporting member extends parallel to the upper leg inside the core structure, the distance between the upper leg and the supporting member corresponding to the dimension of the at least one permanent magnet.

5. A DC inductor according to claim 1, wherein the core structure comprises a first U-shaped core and a second U-shaped core, whereby the second U-shaped core is arranged inside the first U-shaped core such that the legs of the second U-shaped core are arranged to form the supporting members that extend parallel to the core structure inside the core structure.

6. A DC inductor according to claim 5, wherein the DC inductor comprises at least two permanent magnets, which are arranged between outer surfaces of the legs of the second U-shaped core and inner surfaces of legs of the first U-shaped core.

7. A DC inductor according to claim 5, wherein the magnetic path for the magnetization producible by the coil is formed of the first U-shaped core, a base of the second U-shaped core, which base combines the legs of the second U-shaped core, and at least two magnetic slabs, which are arranged between the inner end surfaces of the legs of the first U-shaped core and the outer side surface of the base of the second U-shaped core.

8. A DC inductor according to claim 1, wherein the DC inductor comprises two supporting members, both of which extend from the core structure both inside and outside the core structure, the supporting members being arranged to hold the at least two permanent magnets between them and that the magnetic slab is inserted in the core structure between the supporting members.

9. A DC inductor according to claim 8, wherein the supporting members provide a low reluctance magnetic path for the magnetization produced by the permanent magnets.

10. A DC inductor according to claim 1, wherein the core structure comprises three parallel legs and the supporting member is arranged inside the core structure to hold at least two permanent magnets between the supporting member and the core structure.

11. A DC inductor according to claim 10, wherein the supporting member and the magnetic slab are arranged to form at least one magnetic gap in the core structure to the magnetic path for the magnetization producible by the coil.

12. A DC inductor according to claim 10, wherein the supporting member is arranged on the center leg of the core structure and the permanent magnets are arranged on both ends of the supporting member, while the air gap is situated between the permanent magnets in the center leg.

13. A DC inductor according to claim 10, wherein the supporting member provides a low reluctance magnetic path for the magnetization of permanent magnets between the outer core structure and center leg.

14. A DC inductor according to claim 10, wherein the coil is wound on one or more legs of the core structure.

15. A DC inductor according to claim 1, wherein the core structure comprises three parallel legs and two supporting members are arranged inside the core structure to hold at least two permanent magnets between the supporting members.

16. A DC inductor according to claim 15, wherein the supporting members are arranged on the center leg and magnetic slab is arranged between the supporting members producing the magnetic gap to the center leg of the core structure.

17. A DC inductor according to claim 15, wherein supporting members provide a gapless magnetic path for the magnetization of the permanent magnets.

18. A DC inductor according to claim 15, wherein the DC inductor comprises coils wound on one or more legs of the core structure.

19. A DC inductor according to claim 15, wherein the coil is wound on the center leg of the core structure and arranged to surround the supporting members, permanent magnets (65, 66) and the magnetic slab.

20. A DC inductor according to claim 1, wherein some or each of the one or more magnetic gaps are uniform gaps.

21. A DC inductor according to claim 1, wherein some or each of the one or more magnetic gaps are non-uniform gaps.

* * * * *